US009843882B2

(12) United States Patent
Baba

(10) Patent No.: US 9,843,882 B2
(45) Date of Patent: Dec. 12, 2017

(54) SOUND FIELD CONTROL SYSTEM, ANALYSIS DEVICE, AND ACOUSTIC DEVICE

(71) Applicant: Onkyo Corporation, Osaka (JP)

(72) Inventor: Takayuki Baba, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 15/431,182

(22) Filed: Feb. 13, 2017

(65) Prior Publication Data

US 2017/0245087 A1 Aug. 24, 2017

(30) Foreign Application Priority Data

Feb. 24, 2016 (JP) ..... 2016-033270

(51) Int. Cl.
*H04S 7/00* (2006.01)
*H04R 5/02* (2006.01)
*H04R 29/00* (2006.01)

(52) U.S. Cl.
CPC ..... *H04S 7/301* (2013.01); *H04R 5/02* (2013.01); *H04R 29/001* (2013.01)

(58) Field of Classification Search
None
See application file for complete search history.

(56) References Cited

U.S. PATENT DOCUMENTS

2003/0043051 A1* 3/2003 Shiraishi ..... H04S 7/301 340/4.41
2007/0086597 A1* 4/2007 Kino ..... H04S 7/301 381/59
2007/0253564 A1* 11/2007 Katayama ..... H04S 3/008 381/63
2009/0081948 A1* 3/2009 Banks ..... H04R 5/02 455/3.05
2010/0142735 A1* 6/2010 Yoon ..... H04S 3/002 381/303

(Continued)

FOREIGN PATENT DOCUMENTS

JP 2004-159037 6/2014

OTHER PUBLICATIONS

Extended European Search Report for corresponding App. No. 17157620.0, dated Jun. 16, 2017.

*Primary Examiner* — Paul Huber
(74) *Attorney, Agent, or Firm* — Renner, Otto, Boisselle & Sklar, LLP

(57) ABSTRACT

A sound field control system SY according to the present invention is provided with: a sound emission unit 210 which causes a plurality of speakers to emit a test sound; a sound pickup unit 130 which picks up the test sound using a microphone; an analysis unit 150 which compares information indicating a sound emission timing of a test signal sequence for causing the speakers to successively emit the test sound at a prescribed timing with a sound pickup timing of each test sound that has been picked up, and which calculates a time difference between the sound emission timing of each test sound and the sound pickup timing; and a signal processing unit 230 which performs, based on the calculated time difference between the sound emission timing of each test sound and the sound pickup timing, a delay process for a voice signal supplied to each speaker.

5 Claims, 10 Drawing Sheets

(56) References Cited

U.S. PATENT DOCUMENTS

| | | | | |
|---|---|---|---|---|
| 2013/0058492 | A1* | 3/2013 | Silzle | H04R 5/027 381/59 |
| 2014/0037097 | A1 | 2/2014 | LaBosco | |
| 2015/0358756 | A1* | 12/2015 | Harma | H04S 7/302 381/17 |

* cited by examiner

SOUND FIELD CONTROL SYSTEM, ANALYSIS DEVICE, AND ACOUSTIC DEVICE

BACKGROUND OF THE INVENTION

1. Field of the Invention

The present invention relates to a sound field control system for performing sound field control of an acoustic device including multichannel speakers; an analysis device; an acoustic device; a sound field control system control method; an analysis device control method; an acoustic device control method; a program; and a recording medium.

2. Description of the Related Art

An example of the related art is disclosed in JP-A-2004-159037. JP-A-2004-159037 discloses an automatic acoustic adjustment system in which an acoustic device (acoustic adjustment device) and an analysis device (acoustic analysis device) are connected. The acoustic device is provided with a means for generating a test signal; a means for inputting a sound pickup signal obtained by picking up, using a microphone, a test sound corresponding to a test signal emitted from speakers; and a means for supplying the test signal and the sound pickup signal to the analysis device. The analysis device is provided with a means for performing an acoustic analysis based on the supplied test signal and sound pickup signal, and generating adjustment information to be supplied to the acoustic device (information for performing a voice signal delay process for eliminating sound delay due to variations in the distance from each of the speakers to the microphone); and a means for providing the generated adjustment information to the acoustic device. Accordingly, in JP-A-2004-159037, the adjustment information is generated by the analysis device, providing the effect that sound field control (process of measuring test signal and delaying voice signal) can be implemented without putting control burden on the acoustic device.

SUMMARY OF THE INVENTION

However, in the configuration according to JP-A-2004-159037, it is necessary to attach a microphone to the acoustic device. In a simpler configuration, the sound field control may be performed using a smartphone (a smartphone-mounted microphone) instead of the attached microphone. In this way, the trouble of routing wire cables for the microphone can be eliminated and the cost of the acoustic device can be decreased. However, when a smartphone is used for issuing a sound emission command for test sound and performing sound pickup, the conventional sound field control algorithm using an attached microphone cannot be adopted.

According to the conventional sound field control algorithm, based on the premise that the time from the issuance of the sound emission command for the test sound by the acoustic device and sound emission is known, the distance from the speakers to the microphone is measured. That is, an elapsed time Ta between sound emission command and sound pickup is measured, and a time Tb between sound emission command and sound emission is subtracted therefrom, whereby a time from sound emission by the speakers to sound pickup by the microphone is calculated (Ta−Tb). By multiplying the calculated time (Ta−Tb) from sound emission to sound pickup by the speed of sound, the distance from the speakers to the microphone is determined.

Meanwhile, when a sound emission command is issued using a smartphone, the device that emits sound and the device that issues sound emission command are different. In addition, when a sound emission command is issued from a smartphone via wireless communication, a communication lag is caused in the time between sound emission command and sound emission. As a result, the time Tb between sound emission command and sound emission cannot be accurately measured. Accordingly, there has been the problem that accurate sound field control cannot be performed with the use of a smartphone (i.e., when the time between a sound emission command for test sound and sound emission is unknown).

In view of the above problem, an object of the present invention is to provide: a sound field control system with which accurate sound field control can be performed even when the time between a sound emission command for test sound and sound emission is unknown; an analysis device; an acoustic device; a sound field control system control method; an analysis device control method; an acoustic device control method; a program; and a recording medium.

A sound field control system according to a preferred embodiment of the present invention comprising: a sound emission unit which causes a plurality of speakers to emit a test sound; a sound pickup unit which picks up the test sound using a microphone; an analysis unit which compares information indicating a sound emission timing of a test signal sequence for causing the speakers to successively emit the test sound at a prescribed timing with a sound pickup timing of each test sound that has been picked up, and which calculates a time difference between the sound emission timing of each test sound and the sound pickup timing; and a signal processing unit which performs a delay process for a voice signal supplied to each speaker based on the calculated time difference between the sound emission timing of each test sound and the sound pickup timing.

Preferably, wherein the analysis unit calculates a time difference between a sound emission interval of an n-th (where n is an integer such that $n \geq 1$) test sound to be emitted and an m-th (where m is an integer such that $m \geq n+1$) test sound to be emitted based on the test signal sequence, and a sound pickup interval of the n-th emitted test sound and the m-th emitted test sound obtained from a result of sound pickup by the sound pickup unit.

Preferably, wherein the test signal sequence is a signal sequence for causing the test sound to be emitted at constant intervals.

Preferably, wherein, with reference to a point in time earlier by a predetermined time than the sound pickup timing of the n-th (where n is an integer such that $n \geq 1$) emitted test sound based on the test signal sequence, divided intervals are set at the constant intervals, and the analysis unit calculates a time difference between a time length from a start point of each of the divided intervals to the sound pickup timing of each test sound and the predetermined time.

Preferably, wherein the sound emission unit causes the test sound to be emitted at a sound emission interval corresponding to a characteristic of the speaker for sound emission.

Preferably, comprising: an analysis device including the sound pickup unit and the analysis unit; and an acoustic device including the sound emission unit and the signal processing unit, wherein the analysis device and the acoustic device are connected via wireless communication.

Preferably, wherein: the analysis device includes a sound emission command unit which issues a sound emission command to the sound emission unit of the acoustic device; and the sound emission command unit issues a sound emission command for the test signal sequence via a single wireless communication.

Preferably, An analysis device comprising: a sound emission command unit which issues a sound emission command serving as a command for causing a plurality of speakers to emit a test sound; a sound pickup unit which picks up the test sound using a microphone; an analysis unit which compares information indicating a sound emission timing of a test signal sequence for causing the speakers to successively emit the test sound at a prescribed timing with a sound pickup timing of each test sound that has been picked up, and calculates a time difference between the sound emission timing of each test sound and the sound pickup timing; and an information generation unit which, based on the calculated time difference between the sound emission timing of each test sound and the sound pickup timing, generates adjustment information used for a delay process for a voice signal supplied to each speaker, or sound field control information serving as a command for matching distances from the speakers to the microphone.

Preferably, An acoustic device comprising: a sound emission unit for causing a plurality of speakers to emit a test sound; a sound pickup information reception unit which receives, from an external device having a microphone, sound pickup information indicating a sound pickup timing of each test sound that has been picked up using the microphone; an analysis unit which compares information indicating a sound emission timing of a test signal sequence for causing the speakers to successively emit the test sound at a prescribed timing, with the sound pickup timing of each test sound obtained from the sound pickup information, and which calculates a time difference between the sound emission timing of each test sound and the sound pickup timing; and a signal processing unit which, based on the calculated time difference between the sound emission timing of each test sound and the sound pickup timing, performs a delay process for a voice signal supplied to each speaker.

DETAILED DESCRIPTION OF THE PREFERRED EMBODIMENTS

First Embodiment

Figure 1:
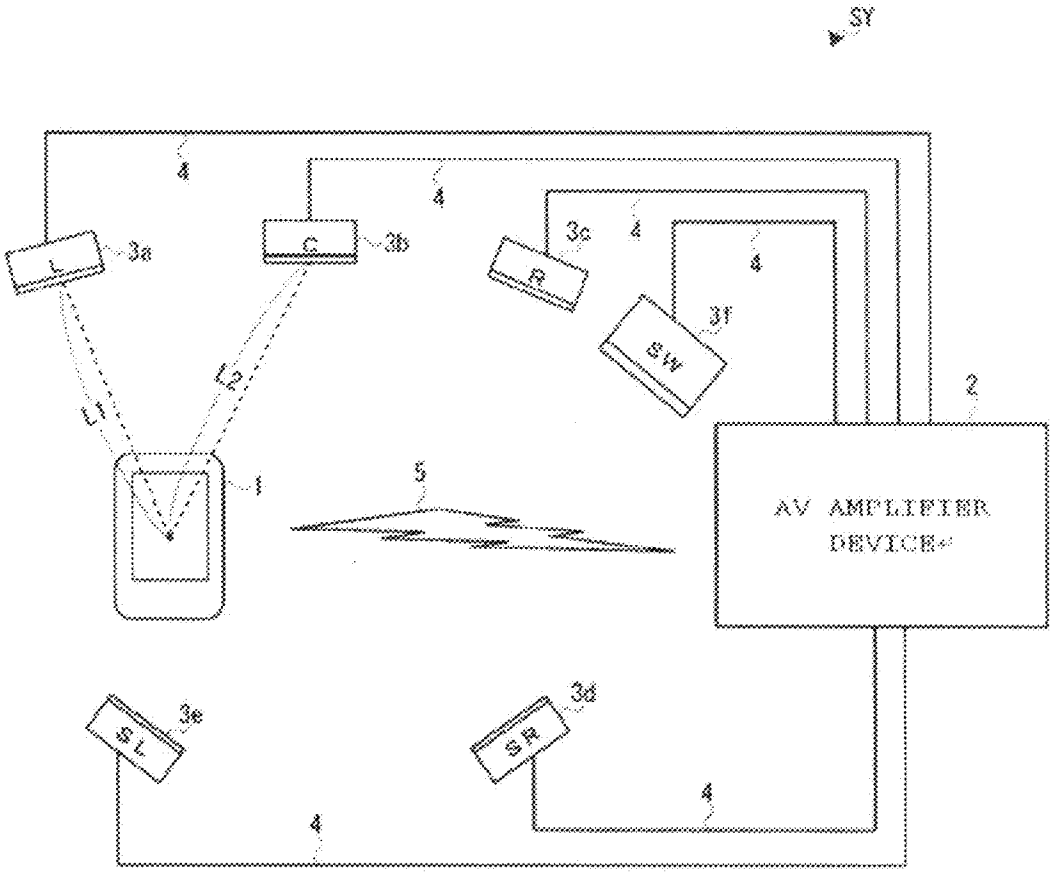
FIG. 1 is a system configuration diagram illustrating a sound field control system.

In the following, a sound field control system, an analysis device, an acoustic device, a sound field control system control method, an analysis device control method, an acoustic device control method, a program, and a recording medium according to an embodiment of the present invention will be described in detail with reference to the attached drawings. FIG. 1 is a system configuration diagram of a sound field control system SY. The sound field control system SY is provided with a smartphone 1 (analysis device; external device), an AV amplifier device 2, and a speaker group 3 (3*a* to 3*f*). An "acoustic device" set forth in the claims refers to the AV amplifier device 2 and the speaker group 3.

The smartphone 1 and the AV amplifier device 2 are connected via wireless communication 5, such as Bluetooth (registered trademark) or a wireless local area network (LAN). The AV amplifier device 2 and the speakers 3*a* to 3*f* are connected via wired communication 4, such as dedicated cables.

The speaker group 3 of the present embodiment is adapted for 5.1 channels, and includes a front-left speaker 3*a* (L), a front-center speaker 3*b* (C), a front-right speaker 3*c* (R), a surround-right speaker 3*d* (SR), a surround-left speaker 3*e* (SL), and a subwoofer 3*f* (SW).

The example illustrated in FIG. 1 is not a limitation, and the number and type of speakers constituting the speaker group 3 may be selected as desired. The AV amplifier device 2 and the speakers 3*a* to 3*f* may be connected via wireless communication. In addition, instead of the smartphone 1, other information processing terminals, such as a tablet terminal, a portable telephone, or a notebook PC may be used. In this case, the AV amplifier device 2 and the information processing terminal may be connected via wired communication in accordance with the communication standard of the information processing terminal.

Figure 2:
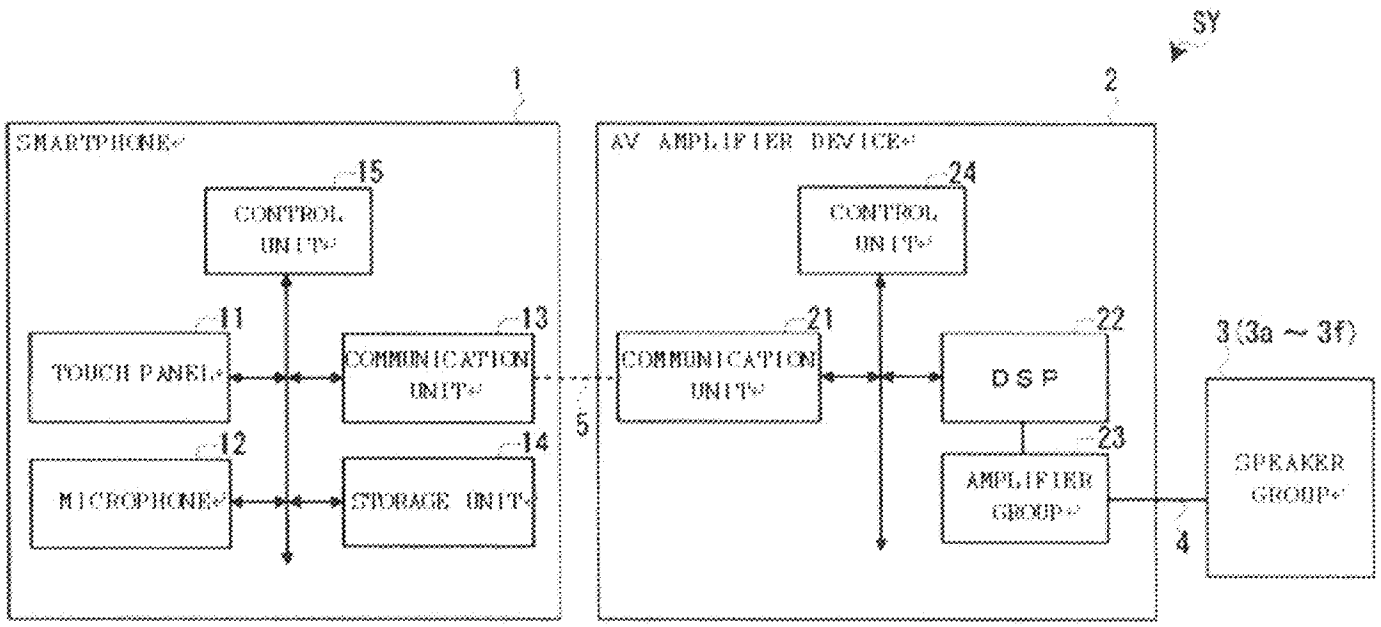
FIG. 2 is a control block diagram illustrating a hardware configuration of the sound field control system.

With reference to FIG. 2, a hardware configuration of the sound field control system SY will be described. The smartphone 1 is provided with a touch panel 11, a microphone 12, a communication unit 13, a storage unit 14, and a control unit 15. The touch panel 11 functions as an operating means and a display means. The microphone 12 picks up sound (inputs a voice signal). The communication unit 13 performs transmission and reception of information with the AV amplifier device 2. The storage unit 14 stores various smartphone applications as well as an operating system (OS) in a nonvolatile manner. The smartphone applications include a sound field control application for sound field control of the AV amplifier device 2. The "sound field control" includes sound emission and measurement of a test sound from the speakers 3*a* to 3*f*, and performing a delay process on a voice signal supplied to the speakers 3*a* to 3*f* based on the measurement result, so as to eliminate sound delay due to variations in the distance between the speakers 3*a* to 3*f* and the listening position (position of the smartphone 1). The control unit 15 is configured from a central processing unit (CPU), a random access memory (RAM) and the like, and performs various computing processes, such as sound field control.

The AV amplifier device 2 is provided with a communication unit 21, a digital signal processor (DSP) 22, an amplifier group 23, and a control unit 24. The communication unit 21 performs transmission and reception of information with the smartphone 1. The DSP 22 performs various digital signal processes, such as a voice signal delay process. The amplifier group 23 includes a plurality of amplifiers (not illustrated) corresponding to the respective channels. The amplifiers respectively amplify the voice signals of the channels, and supply the voice signals to the corresponding speakers 3*a* to 3*f*. The control unit 24 is configured from a CPU, a RAM and the like, and performs various computing processes, such as reproduction control. Meanwhile, the speaker group 3 emits sound (outputs a voice signal).

Figure 3:
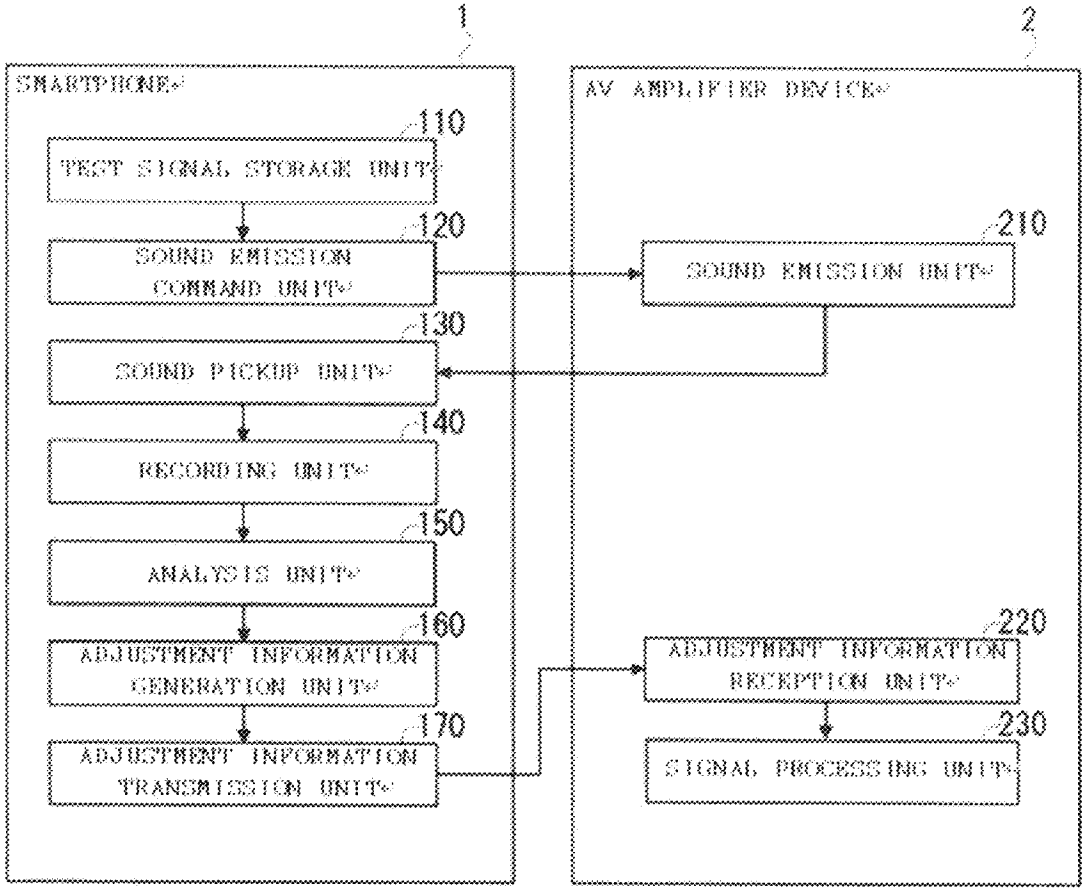
FIG. 3 is a functional block diagram illustrating a functional configuration of a smartphone and an AV amplifier device according to a first embodiment.

With reference to FIG. 3, a functional configuration of the smartphone 1 and the AV amplifier device 2 will be described. The smartphone 1 has a functional configuration provided with: a test signal storage unit 110; a sound emission command unit 120; a sound pickup unit 130; a recording unit 140; an analysis unit 150; an adjustment information generation unit 160 (information generation unit); and an adjustment information transmission unit 170. The AV amplifier device 2 has a functional configuration provided with: a sound emission unit 210; an adjustment information reception unit 220; and a signal processing unit 230. The units 110 to 170 of the smartphone 1 are mainly implemented by the above-described sound field control application.

The test signal storage unit 110 of the smartphone 1 stores a test signal sequence which is used when sound field control is performed. The test signal sequence according to the present embodiment is adapted for successive sound emission of the test sound from the speakers 3*a* to 3*f* at prescribed timing (at a prescribed timing setting). The sound emission unit 210 of the AV amplifier device 2 causes the speaker group 3 to emit a number of test sounds corresponding to the number of connected speakers, based on the test signal sequence, at prescribed sound emission intervals and in a prescribed order (sound emission step). The sound emission unit 210 uses the DSP 22 and the control unit 24 as major units.

Figure 4:
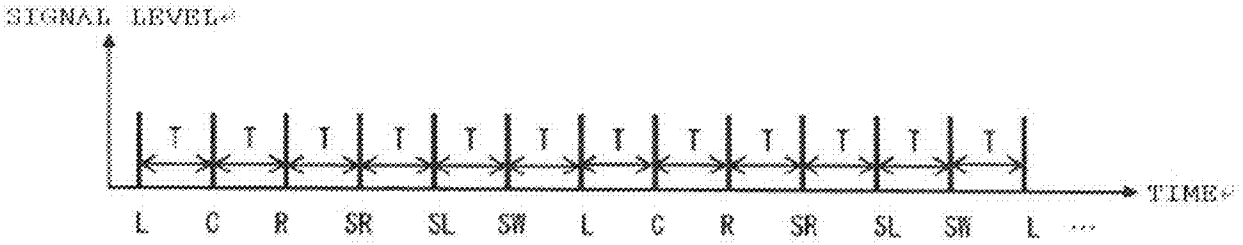
FIG. 4 is a diagram illustrating an example of a test signal sequence according to the first embodiment.

FIG. 4 is a diagram illustrating an example of the test signal sequence. As illustrated in the figure, according to the present embodiment, the test signal sounds are emitted from the speakers 3*a* to 3*f* in the order of front-left (L), front-center (C), front-right (R), surround-right (SR), surround-left (SL), and subwoofer 3*f* (SW). In addition, according to the present embodiment, the sound emission interval of the test sound is a constant time T (regular intervals). The sound emission unit 210 causes the sound of the test sound sequence based on the test signal sequence to be emitted a number of times corresponding to a prescribed number of times of repetition. Preferably, as the test sound, a signal of which the signal level changes sharply, such as an impulse signal, may be used.

Meanwhile, the test signal storage unit 110 stores test signal sequences for each device type of the AV amplifier device 2 or speaker configuration (number of channels). The sound emission command unit 120, which will be described later, issues a sound emission command using a test signal sequence suitable for the AV amplifier device 2 to be connected (sound emission command step). That is, at the time of establishing connection with the AV amplifier device 2, the device type or speaker configuration is determined, and the test signal sequence to be used is determined in accordance with the determination result. In another configuration, the test signal sequence to be used may be determined by the selection of the device type or speaker configuration by a user.

The sound emission command unit 120 of the smartphone 1 issues the test signal sound emission command to the AV amplifier device 2. According to the present embodiment, instead of issuing the sound emission command for each test signal (test sound), the sound emission command for the test signal sequence (test sound sequence) is issued through a single wireless communication. The sound emission unit 210 of the AV amplifier device 2 causes the speaker group 3 to emit the sound of the test sound sequence in accordance with the sound emission command from the sound emission command unit 120.

Figure 5:
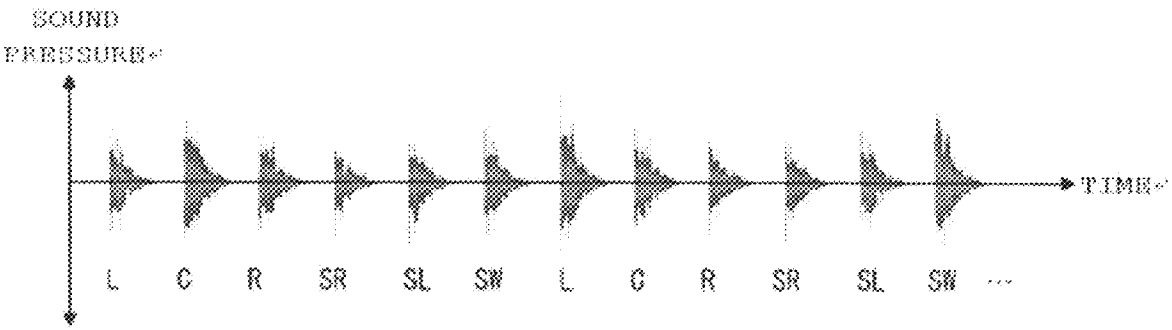
FIG. 5 is a diagram illustrating an example of a recording sound waveform of a recording of a test sound sequence.

The sound pickup unit 130 of the smartphone 1 picks up the sound of the test sound sequence using the microphone 12 (sound pickup step). The sound pickup unit 130 uses the storage unit 14 (sound field control application) and the control unit 24 as major units. The recording unit 140 of the smartphone 1 records the test sound sequence picked up by the sound pickup unit 130. FIG. 5 is a diagram illustrating an example of the recording sound waveform recorded by the recording unit 140. The figure illustrates a recording of the test sound sequence waveform based on the test signal sequence illustrated in FIG. 4.

The analysis unit 150 of the smartphone 1 compares the information indicating the sound emission timing of the test signal sequence according to the sound emission command from the sound emission command unit 120 with the sound pickup timing of each test sound picked up by the sound pickup unit 130, and calculates a time difference between the sound emission timing of each test sound and the sound pickup timing (analysis step). Specifically, the analysis unit 150 calculates a time difference ($\Delta Tn$) between a sound emission interval (T) of the n-th (n is an integer such that $n \geq 1$) test sound to be emitted and the n+1th test sound to be emitted based on the test signal sequence, and a sound pickup interval ($T+\Delta Tn$) between the n-th emitted test sound and the n+1th emitted test sound obtained from the result of sound pickup by the sound pickup unit 130.

The "the information indicating the sound emission timing of the test signal sequence" is information defining the sound emission timing of the test signal sequence, and is defined by the sound emission interval of the test signal sequence according to the present embodiment. The "sound pickup timing" indicates the point in time at which the sound pressure (the amplitude of the recording sound waveform) has exceeded a predetermined threshold value. In order to accurately detect the sound pickup timing, there may be provided a signal squaring circuit for squaring the sound pickup signal, a smoothing circuit to which the output of the signal squaring circuit is input, and a differential processing unit to which the output of the smoothing circuit is input (which circuits are not illustrated), and the time at which the value obtained by differentiation by the differential processing unit becomes a maximum value or a minimum value may be detected as the sound pickup timing.

Figure 6:
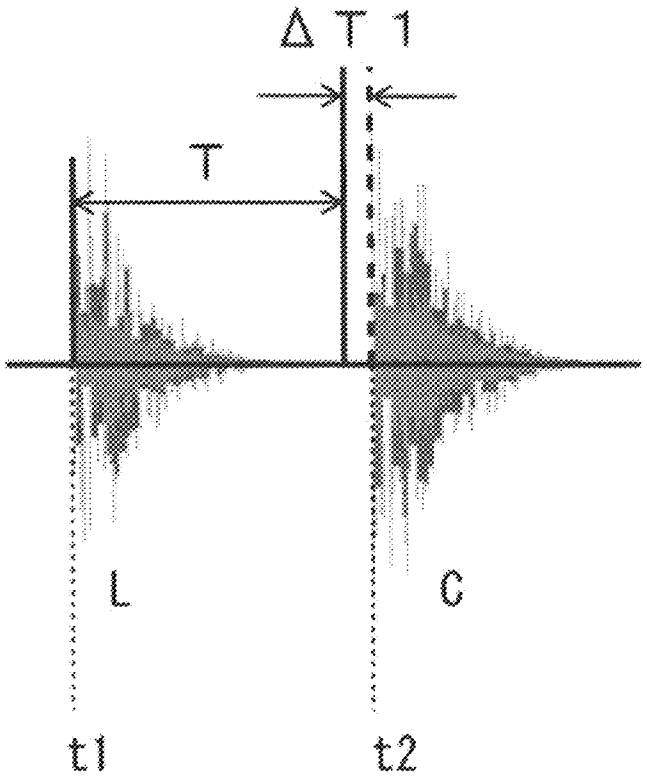
FIG. 6 is an illustrative diagram illustrating a time difference between a sound emission interval of test sound and a sound pickup interval.

FIG. 6 is a diagram illustrating the time difference between the sound emission interval of test sound and the sound pickup interval. The figure indicates that: the sound pickup timing of the test sound emitted from the front-left speaker 3*a* (L) (first test sound) is t1; the sound pickup timing of the test sound emitted from the front-center speaker 3*b* (C) (second test sound) is t2; and the elapsed time from t1 to t2 corresponds to the time of the sound emission interval T of test sound to which $\Delta T1$ is added. Accordingly, in the illustrated example, the sound pickup interval between the first test sound and the second test sound is $T+\Delta T1$, where $\Delta T1$ is the time difference between the sound emission interval and the sound pickup interval, indicating that the distance L2 (linear distance) from the smartphone 1 to the front-center speaker 3*b* (C) is greater than the distance L1 (linear distance) from the smartphone 1 to the front-left speaker 3*a* (L) (see FIG. 1). That is, when $\Delta T1$ is 2 msec, for example, it can be calculated that the distance L2 is greater than the distance L1 by 2 msec×1/1000×340 m/sec (the speed of sound)=0.68 m=68 cm. In FIG. 1, the distances from the center of the smartphone 1 to the front face center of the speakers 3*a* and 3*b* are respectively indicated as L1 and L2. However, with respect to the smartphone 1, the mount position of the microphone 12 may be used as the reference, or an estimated position of the head of the user when holding the smartphone 1 may be used as the reference. Alternatively, instead of the front face center of the speakers 3*a* and 3*b*, other positions of the speakers 3*a* and 3*b* may be used as the reference.

In the present embodiment, because the number of speakers is six, time differences other than ΔT1 are also calculated, including: the time difference ΔT2 between the sound emission interval of the second test sound (for C) and the third test sound (for R) and the sound pickup interval; the time difference ΔT3 between the sound emission interval of the third test sound (for R) and the fourth test sound (for SR) and the sound pickup interval; the time difference ΔT4 between the sound emission interval of the fourth test sound (for SR) and the fifth test sound (for SL) and the sound pickup interval; and the time difference ΔT5 between the sound emission interval of the fifth test sound (for SL) and the sixth test sound (for SW) and the sound pickup interval; the time difference ΔT6 between the sound emission interval of the sixth test sound (for SW) and the seventh test sound (for L) and the sound pickup interval. Because the sound emission of the test sound sequence is repeated multiple times, ΔT1 to ΔT6 are calculated based on the measurement results for the multiple times (for example, based on an average value of the measurement results for the multiple times). The time difference ΔTn may become minus.

The adjustment information generation unit 160 of the smartphone 1 generates adjustment information to be used for a delay process for a voice signal supplied to each of the speakers 3*a* to 3*f* (information generation step), based on an analysis result from the analysis unit 150. Specifically, the speaker with the greatest distance Ln from the smartphone 1 is identified. With reference to the channel corresponding to that speaker, a voice signal delay amount for each of the other five channels is calculated. The result of the calculation is generated as the adjustment information. For example, of the six speakers 3*a* to 3*f*, when the speaker 3 with the greatest distance Ln from the smartphone 1 is the L channel front-left speaker 3*a*, the adjustment information is generated which causes the C channel to be delayed by "ΔT1", the R channel to be delayed by "ΔT1+ΔT2", the SR channel to be delayed by "ΔT1+ΔT2+ΔT3", the SL channel to be delayed by "ΔT1+ΔT2+ΔT3+ΔT4", and the SW channel to be delayed by "ΔT1+ΔT2+ΔT3+ΔT4+ΔT5". The adjustment information transmission unit 170 transmits the adjustment information generated by the adjustment information generation unit 160 to the AV amplifier device 2. Of the six speakers 3*a* to 3*f*, the speaker 3 with the greatest distance Ln from the smartphone 1 can be identified by performing computation using ΔT1 to ΔT6 that have been calculated.

The adjustment information reception unit 220 of the AV amplifier device 2 receives the transmitted adjustment information. The signal processing unit 230 performs the delay process for the voice signal supplied to each of the speakers 3*a* to 3*f* (signal processing step) based on the received adjustment information. For example, when the speaker 3*a* (for L) has the greatest distance from the smartphone 1 as in the above example, the delay process is performed for the channels corresponding to the other speakers 3*b*, 3*c*, 3*d*, 3*e*, and 3*f*.

Figure 7:
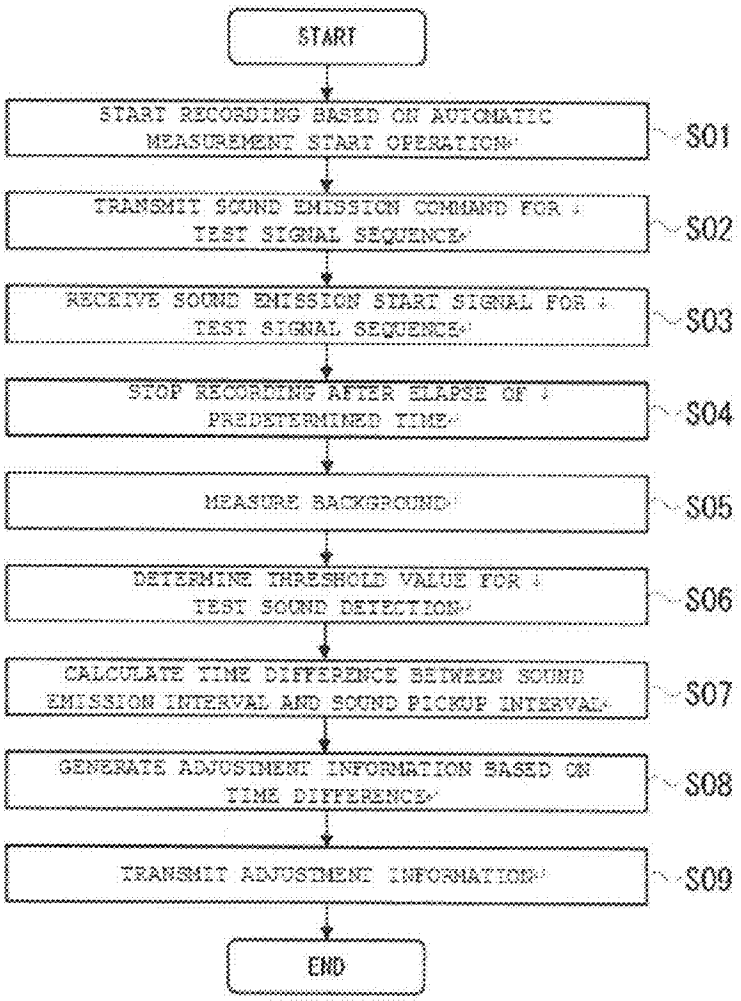
FIG. 7 is a flowchart of a process flow of a smartphone.

With reference to the flowchart of FIG. 7, a process flow of the smartphone 1 for performing sound field control will be described. The smartphone 1 starts recording based on an automatic measurement start operation with respect to the touch panel 11 (S01). Then, a sound emission command for the test signal sequence (test signal sequence+control signal) is transmitted to the AV amplifier device 2 (S02), and a sound emission start signal for the test signal sequence is received from the AV amplifier device 2 (S03). After the elapse of a predetermined time from the reception of the sound emission start signal, the smartphone 1 stops the recording (S04). A configuration may be adopted such that, instead of at S01, the recording is started after the sound emission start signal is received. In another configuration, the automatic measurement start operation in S01 may be performed with respect to the AV amplifier device 2, and the corresponding operation signal may be transmitted from the AV amplifier device 2 to the smartphone 1.

The smartphone 1, after the end of the recording, measures background (background noise) (S05), and determines a threshold value for test sound detection (S06). Based on the threshold value, the sound pickup timing of each test sound is detected, and, for all of the speakers, the time difference between the sound emission interval and the sound pickup interval is calculated (S07). Thereafter, the smartphone 1 generates the adjustment information based on the time difference (S08), and transmits the adjustment information to the AV amplifier device (S09). While not illustrated, the AV amplifier device 2 subsequently performs a voice signal delay process based on the adjustment information (delay amount setting for each channel by the DSP 22), and, after the end of the delay process, transmits a process-end indicating signal to the smartphone 1. The smartphone 1, upon reception of the signal, ends the series of processes relating to sound field control.

As described above, the sound field control system SY according to the present embodiment calculates the time difference between the sound emission timing of each test sound and the sound pickup timing by comparing the information indicating the sound emission timing of the test signal sequence with the sound pickup timing of each test sound, and performs the delay process for a voice signal supplied to each of the speakers 3*a* to 3*f*, based on the time difference. Accordingly, even when the time between the sound emission command for test sound and sound emission is unknown, accurate sound field control can be performed. In other words, accurate sound field control can be implemented using the smartphone 1, which is handy, without fitting the AV amplifier device 2 with a microphone.

The sound emission command from the smartphone 1 to the AV amplifier device 2 is issued through a single wireless communication for the test signal sequence (entire test sound). Accordingly, even if the communication environment of the wireless communication 5 is not stable, accurate sound field control can be implemented. In the case where a sound emission command is issued for each test signal, if the communication environment is unstable, the time between the sound emission command to sound emission may not become constant, resulting in a failure to measure the difference in distance from the speakers 3*a* to 3*f* to the smartphone 1 (microphone 12) accurately. In contrast, according to the present embodiment, such problem is not encountered because the sound emission command for the entire test sounds is issued through a single wireless communication.

The embodiment does not represent a limitation, and the following modifications may be adopted.

First Modification

Figure 8:
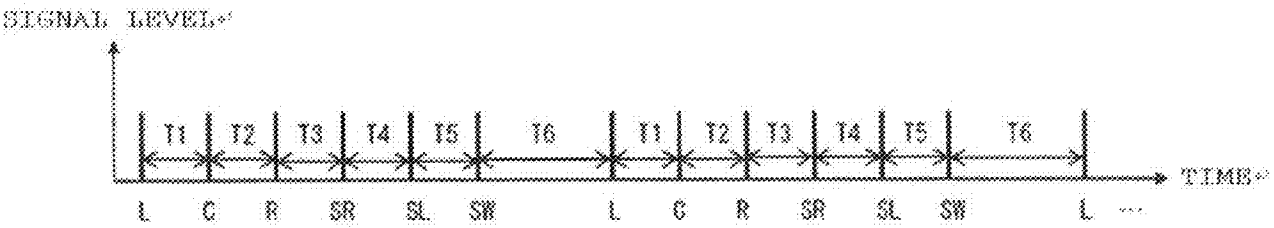
FIG. 8 is a diagram illustrating an example of a test signal sequence according to a first modification.

In the above-described embodiment, the sound emission unit 210 is caused to emit the test sound at constant intervals. However, the sound emission may be performed at sound emission intervals in accordance with the characteristics of the speaker for the sound emission. FIG. 8 is a diagram illustrating an example of the test signal sequence according to a first modification. In the illustrated example, the sound emission interval (T6) between the subwoofer 3*f* (SW) and the front-left speaker 3*a* (L) is set to be greater than the other sound emission intervals (T1 to T5). With regard to the subwoofer 3*f* (SW), which emits sound with much reverberation, by thus setting a wider interval before the sound emission timing of the next test sound, the sound pickup timing of the next test sound can be accurately detected, whereby more accurate sound field control can be implemented.

In another modification, in the example of FIG. 8, different intervals may be set for the sound emission intervals of T1 to T5, rather than the constant intervals. In addition, the test sound may be emitted at a sound emission timing in accordance with certain times (such as triple time or quadruple time) or in a predetermined rhythm (such as the "rhythm of the first bar of the . . . song"). In this way, the user can be let known about ongoing sound field control while being spared from being bored. When the "sound emission timing" is defined in terms of the time or rhythm, it may be also necessary to define the time length of the entirety or a part thereof (such as for one bar). That is, it may be necessary to add information enabling identification of the sound emission interval of the test sound.

Second Modification

While in the above-described embodiment, the smartphone 1 is provided with the test signal storage unit 110, the AV amplifier device 2 may be provided with the test signal storage unit 110. In this case, the sound emission command unit 120 of the smartphone 1 only issues the sound emission command, and the sound emission unit 210 of the AV amplifier device 2 causes the speaker group 3 to emit the test sound based on a test signal sequence stored in advance. The smartphone 1, at the time of establishing connection or issuing a sound emission command, acquires the test signal sequence from the AV amplifier device 2, and compares, using the analysis unit 150, the information indicating the sound emission timing of the acquired test signal sequence with the sound pickup timing of each test sound picked up by the sound pickup unit 130.

In yet another modification, the smartphone 1 and the AV amplifier device 2 may both be provided with the test signal storage unit 110. In this case, the smartphone 1 does not need to acquire the test signal sequence from the AV amplifier device 2, and may determine the device type of the connected AV amplifier device 2 or the number of speakers, read from the test signal storage unit 110 the test signal sequence for the connected AV amplifier device 2 based on the determination result, and then perform an analysis using the analysis unit 150.

Third Modification

In the above-described embodiment, the adjustment information generation unit 160 is provided in the smartphone 1 (see FIG. 3). However, the adjustment information generation unit 160 may be provided in the AV amplifier device 2. In this case, the smartphone 1 may transmit the result of analysis by the analysis unit 150 (time differences ΔT1 to ΔT6) to the AV amplifier device 2. In a further modification, instead of generating the adjustment information in the AV amplifier device 2, the delay process by the signal processing unit 230 may be performed directly from the result of analysis by the analysis unit 150.

Fourth Modification

The analysis unit 150 and the adjustment information generation unit 160 may be provided in the AV amplifier device 2. In this case, the smartphone 1 transmits the sound pickup information indicating the timing of sound pickup of each test sound by the sound pickup unit 130 to the AV amplifier device 2. The AV amplifier device 2 receives the sound pickup information (sound pickup information reception unit; sound pickup information reception step), and compares, using the analysis unit 150, the information indicating the sound emission timing of the test signal sequence with the sound pickup timing of each test sound obtained from the sound pickup information to calculate the time difference between the sound emission timing of each test sound and the sound pickup timing. The smartphone 1 may transmit, as the sound pickup information, a recording sound waveform recorded by the recording unit 140.

Fifth Modification

In the above-described embodiment, the time difference between the sound emission interval of the n-th test sound to be emitted by the analysis unit 150 and the n+1th test sound to be emitted and the sound pickup interval of the n-th emitted test sound and the n+1th emitted test sound is calculated for the number of the speakers (ΔT1 to ΔT6). However, the time difference between the sound emission interval of the n-th test sound to be emitted and the m-th (m is an integer such that m>n+1) test sound to be emitted and the sound pickup interval of the n-th emitted test sound and the m-th emitted test sound may be calculated (m may not be n+1). In yet further modification, instead of determining the sound emission interval and the sound pickup interval, simply the information indicating the sound emission timing of the test signal sequence and the sound pickup timing of each test sound may be compared, and the time difference between the sound emission timing of each test sound and the sound pickup timing may be calculated based on a predetermined algorithm.

Sixth Modification

Figure 9:
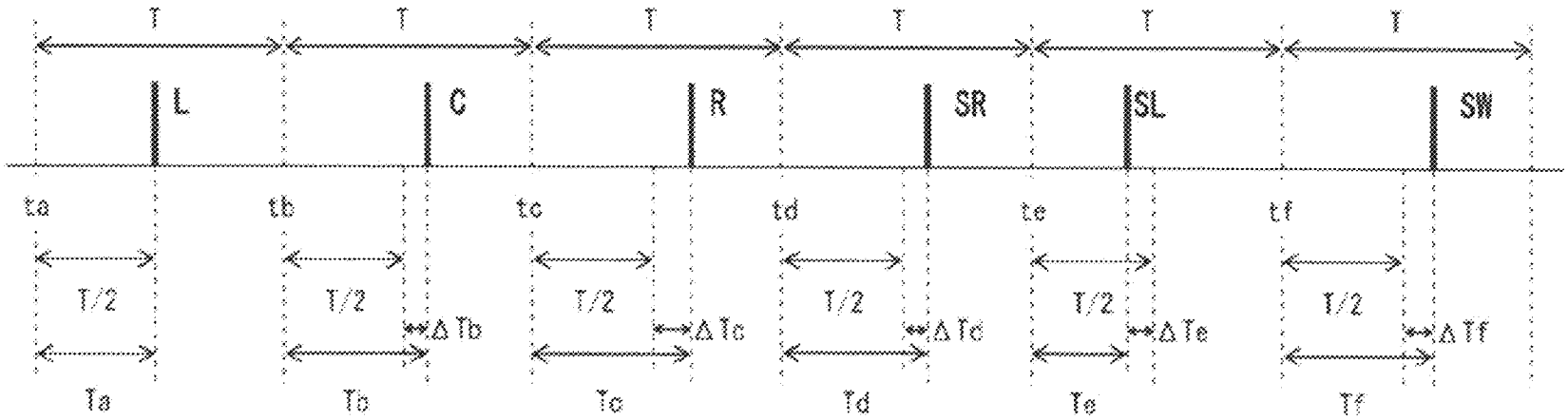
FIG. 9 is an illustrative diagram illustrating sound pickup timing for test sound according to a sixth modification.

In the above-described embodiment, the time difference ΔTn is determined from the sound pickup interval (T+ΔTn) of the n-th emitted test sound and the n+1th emitted test sound, and the delay amount of each channel is calculated from the time difference ΔTn (see FIG. 6). However, as illustrated in FIG. 9, with reference to a point in time earlier than the sound pickup timing of the initially emitted test sound (in the illustrated example, the sound pickup timing of L channel) by a predetermined time, a delay amount from a reference channel corresponding to an arbitrary test sound may be calculated. This example is based on the assumption that the test sound is emitted at constant intervals T. In addition, in the figure, with reference to a point in time (ta) earlier than the sound pickup timing of an arbitrary test sound by T/2, divided intervals are set at constant intervals T, and the start points of the divided intervals are indicated as ta to tf. In this case, the time length Tb from tb to the sound pickup timing of the second test sound (for C) can be represented as "Tb=T/2+ΔTb". Similarly, the time length Tc from tc to the sound pickup timing of the third test sound (for R) can be represented as "Tc=T/2+ΔTc"; the time length Td from td to the sound pickup timing of the fourth test sound (for SR) can be represented as "Td=T/2+ΔTd"; the time length Te from te to the sound pickup timing of the fifth test sound (for SL) can be represented as "Te=T/2+ΔTe"; and the time length Tf from tf to the sound pickup timing of the sixth test sound (for SW) can be represented as "Tf=T/2+ΔTf". In some cases, ΔTb to ΔTf may be minus. In such cases, the adjustment information generation unit 160, based on the time difference between the time length from the start point of each divided interval and the sound pickup timing of each test sound and the predetermined time (T/2), generates the adjustment information. That is, the adjustment information generation unit 160 generates the adjustment information for causing the C channel to be delayed by −ΔTb (made earlier by ΔTb); the R channel to be delayed by −ΔTc; the SR channel to be delayed by −ΔTd; the SL channel to be delayed by −ΔTe; and the SW channel to be delayed by −ΔTf, with respect to the L channel. It should be noted, however, that, when the speaker with the greatest distance Ln from the smartphone 1 is not the L channel speaker 3*a*, the speaker with the greatest distance Ln from the smartphone 1 is identified, and, with reference to the channel corresponding to that speaker, the delay amount is calculated for each of the other five channels. Then, the result of the calculation is generated as the adjustment information.

Accordingly, with reference to the point in time earlier than the sound pickup timing (t1) of an arbitrary test sound by a predetermined time, the delay amounts for the other channels are calculated from the reference channel corresponding to the arbitrary test sound. In this way, the time difference can be calculated in the interval T. That is, the sound pickup timings t1 and t2 may be searched for in each of divided intervals of ta to tb and tb to tc, whereby the time difference can be calculated even in a small work area. In addition, instead of calculating the delay amount between channels by determining the time difference ΔTn from the sound pickup interval of the test sound (T+ΔTn), the delay amount from the reference channel (L channel in the present example) is calculated, so that the adjustment information can be generated easily.

The predetermined time may not be T/2 and may be a value obtained by multiplying the sound emission interval T by a predetermined value, such as T/3 or T/4. The predetermined time may be unrelated to the sound emission interval T and may be a previously defined value. Instead of using the point in time earlier than the sound pickup timing of the initially emitted test sound by a predetermined time as the reference, the point in time earlier than the sound pickup timing of the second or subsequent emitted test sound by a predetermined time may be used as the reference.

Second Embodiment

Figure 10:
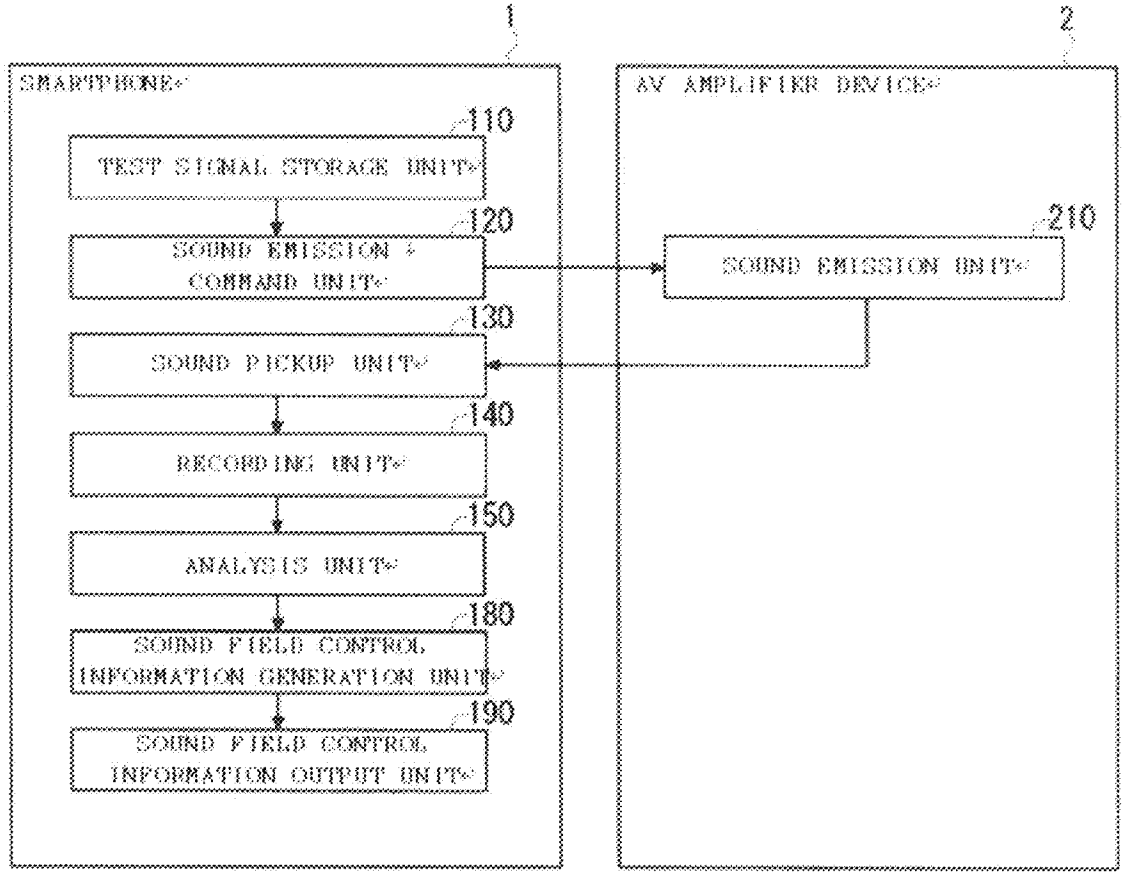
FIG. 10 is a functional block diagram illustrating a functional configuration of a smartphone and an AV amplifier device according to a second embodiment.

With reference to FIG. 10, a second embodiment of the present invention will be described. In the first embodiment, the adjustment information for performing the voice signal delay process is generated. In the present embodiment, sound field control information for allowing the user to adjust the position of each of the speakers 3*a* to 3*f* is generated. The following description only focuses on differences from the first embodiment. In the description of the present embodiment, constituent portions similar to those of the first embodiment are designated with similar signs, and their detailed description is omitted. The modifications applied to the constituent portions similar to those of the first embodiment are also similarly applied to the present embodiment.

FIG. 10 is a functional block diagram illustrating the functional configuration of the smartphone 1 and the AV amplifier device 2 according to the second embodiment. The smartphone 1 is configured such that, compared with the functional configuration (see FIG. 3) of the first embodiment, the adjustment information generation unit 160 and the adjustment information transmission unit 170 are omitted, and a sound field control information generation unit 180 (information generation unit) and a sound field control information output unit 190 are added. The units 110 to 150, 160, and 170 of the smartphone 1 are implemented by a sound field control application serving as a smartphone application, as in the first embodiment. Meanwhile, the AV amplifier device 2 is configured such that, compared with the functional configuration of the first embodiment, the adjustment information reception unit 220 and the signal processing unit 230 are omitted.

The sound field control information generation unit 180, based on the time difference (time differences ΔT1 to ΔT6) between the sound emission timing of each test sound calculated by the analysis unit 150 and the sound pickup timing, generates sound field control information as a command for matching the distances from the speakers 3*a* to 3*f* to the smartphone 1 (microphone 12) (sound field control information generation step; information generation step). According to the present embodiment, as the sound field control information, a message is generated for the user to adjust the position of each of the speakers 3*a* to 3*f*. For example, the generated message is "Move the front-left speaker toward the smartphone by 50 cm and toward the front-center speaker by 30 cm", thus indicating the speaker to be moved, the amount of movement, and the direction of movement. The message to the user may be more abstract, such as "Move the front-left speaker a little (toward the user)".

The sound field control information output unit 190 outputs the sound field control information generated by the sound field control information generation unit 180 (sound field control information output step). The present embodiment uses the output method of displaying the message on the touch panel 11. Instead of the display, the message may be output via voice guidance or a communication means such as electronic mail.

As described above, according to the configuration of the second embodiment, the user is allowed to adjust the speaker position. Accordingly, the voice signal delay process by the AV amplifier device 2 can be omitted, whereby the control burden and cost for the AV amplifier device 2 can be decreased.

In the second embodiment, the following modifications may be adopted.

First Modification

If the speakers are self-propelled, a control signal for the speakers 3*a* to 3*f* may be output as the "sound field control information". In this case, the sound field control information generation unit 180 generates, as the "sound field control information", a control signal indicating the speaker to be moved, the amount of movement, and the direction of movement. The sound field control information output unit 190 outputs the sound field control information to the speakers 3*a* to 3*f*. The speakers 3*a* to 3*f*, based on the acquired sound field control information, move by a self-propelled means which is not illustrated. In this configuration, the distances from the speakers 3*a* to 3*f* to the smartphone 1 (microphone 12) can be matched without bothering the user.

While two embodiments and various modifications have been described, the constituent elements of the sound field control system SY (smartphone 1, AV amplifier device 2) according to the embodiments or modifications may be provided in the form of a program. The program may be stored in and provided as various recording media (such as a CD-ROM and flash memory). That is, the scope of the present invention includes a program for causing a computer to function as the constituent elements of the smartphone 1 or AV amplifier device 2 (including the sound field control application in the embodiments), and a computer-readable recording medium having the program recorded thereon. Other appropriate modifications within the scope of the present invention may also be made.

What is claimed is:

1. A sound field control system comprising:

a sound emission unit which causes a plurality of speakers to emit a test sound;

a sound pickup unit which picks up the test sound using a microphone;

an analysis unit which compares information indicating a sound emission timing of a test signal sequence for causing the speakers to successively emit the test sound at a prescribed timing with a sound pickup timing of each test sound that has been picked up, and which calculates a time difference between the sound emission timing of each test sound and the sound pickup timing; and a signal processing unit which performs a delay process for a voice signal supplied to each speaker based on the calculated time difference between the sound emission timing of each test sound and the sound pickup timing, wherein the test signal sequence is a signal sequence for causing the test sound to be emitted at constant intervals, and with reference to a point in time earlier by a predetermined time than the sound pickup timing of the n-th (where n is an integer such that n≥1) emitted test sound based on the test signal sequence, divided intervals are set at the constant intervals, and the analysis unit calculates a time difference between a time length from a start point of each of the divided intervals to the sound pickup timing of each test sound and the predetermined time.

2. The sound field control system according to claim 1, comprising:

an analysis device including the sound pickup unit and the analysis unit; and an acoustic device including the sound emission unit and the signal processing unit, wherein the analysis device and the acoustic device are connected via wireless communication.

3. The sound field control system according to claim 2, wherein:

the analysis device includes a sound emission command unit which issues a sound emission command to the sound emission unit of the acoustic device; and the sound emission command unit issues a sound emission command for the test signal sequence via a single wireless communication.

4. An analysis device comprising:

a sound emission command unit which issues a sound emission command serving as a command for causing a plurality of speakers to emit a test sound;

a sound pickup unit which picks up the test sound using a microphone;

an analysis unit which compares information indicating a sound emission timing of a test signal sequence for causing the speakers to successively emit the test sound at a prescribed timing with a sound pickup timing of each test sound that has been picked up, and calculates a time difference between the sound emission timing of each test sound and the sound pickup timing; and an information generation unit which, based on the calculated time difference between the sound emission timing of each test sound and the sound pickup timing, generates adjustment information used for a delay process for a voice signal supplied to each speaker, or sound field control information serving as a command for matching distances from the speakers to the microphone, wherein the test signal sequence is a signal sequence for causing the test sound to be emitted at constant intervals, and with reference to a point in time earlier by a predetermined time than the sound pickup timing of the n-th (where n is an integer such that n≥1) emitted test sound based on the test signal sequence, divided intervals are set at the constant intervals, and the analysis unit calculates a time difference between a time length from a start point of each of the divided intervals to the sound pickup timing of each test sound and the predetermined time.

5. An acoustic device comprising:

a sound emission unit for causing a plurality of speakers to emit a test sound;

a sound pickup information reception unit which receives, from an external device having a microphone, sound pickup information indicating a sound pickup timing of each test sound that has been picked up using the microphone;

an analysis unit which compares information indicating a sound emission timing of a test signal sequence for causing the speakers to successively emit the test sound at a prescribed timing, with the sound pickup timing of each test sound obtained from the sound pickup information, and which calculates a time difference between the sound emission timing of each test sound and the sound pickup timing; and a signal processing unit which, based on the calculated time difference between the sound emission timing of each test sound and the sound pickup timing, performs a delay process for a voice signal supplied to each speaker, wherein the test signal sequence is a signal sequence for causing the test sound to be emitted at constant intervals, and with reference to a point in time earlier by a predetermined time than the sound pickup timing of the n-th (where n is an integer such that n≥1) emitted test sound based on the test signal sequence, divided intervals are set at the constant intervals, and the analysis unit calculates a time difference between a time length from a start point of each of the divided intervals to the sound pickup timing of each test sound and the predetermined time.

* * * * *